US008756965B1

(12) United States Patent
Anderson

(10) Patent No.: US 8,756,965 B1
(45) Date of Patent: Jun. 24, 2014

(54) BURGLARY PREVENTION DEVICE AND ASSOCIATED USE THEREOF

(71) Applicant: Huey Anderson, State Line, MS (US)

(72) Inventor: Huey Anderson, State Line, MS (US)

( * ) Notice: Subject to any disclaimer, the term of this patent is extended or adjusted under 35 U.S.C. 154(b) by 0 days.

(21) Appl. No.: 13/745,672

(22) Filed: Jan. 18, 2013

(51) Int. Cl.
*E05B 17/18* (2006.01)

(52) U.S. Cl.
USPC ..... 70/455; 70/14; 70/416; 292/264; 292/288

(58) Field of Classification Search
USPC ..... 70/14, 94, 30, 49, 232, 455, 416, 70/DIG. 58; 292/288, 262, 264, DIG. 2
See application file for complete search history.

(56) References Cited

U.S. PATENT DOCUMENTS

| | | | | | |
|---|---|---|---|---|---|
| 3,210,972 | A * | 10/1965 | Johnson | 70/211 |
| 3,739,608 | A * | 6/1973 | Young | 70/209 |
| 3,952,564 | A * | 4/1976 | Maines | 70/416 |
| 4,285,221 | A * | 8/1981 | Atchisson | 70/416 |
| 4,503,692 | A * | 3/1985 | Grint | 70/418 |
| 4,629,229 | A * | 12/1986 | Correnti et al. | 292/246 |
| 4,798,069 | A * | 1/1989 | DeForrest, Sr. | 70/428 |
| 4,827,745 | A * | 5/1989 | Baugh | 70/416 |
| 4,876,867 | A * | 10/1989 | Leneave | 70/420 |
| 4,899,564 | A * | 2/1990 | Gilbert | 70/428 |
| 5,201,202 | A * | 4/1993 | Kam | 70/168 |
| 5,425,256 | A * | 6/1995 | Crosby | 70/209 |
| 5,448,842 | A * | 9/1995 | Sonstroem | 40/331 |
| 5,560,235 | A * | 10/1996 | Aucoin | 70/455 |
| 5,573,289 | A * | 11/1996 | Littlefair | 292/264 |
| 5,716,084 | A * | 2/1998 | Sanford et al. | 292/264 |
| 5,794,871 | A * | 8/1998 | Willetts | 292/288 |
| 5,799,521 | A * | 9/1998 | Kennedy | 70/416 |
| 6,182,485 | B1 * | 2/2001 | Moore | 70/416 |
| 6,658,906 | B1 * | 12/2003 | Wright | 70/455 |
| 7,175,213 | B1 * | 2/2007 | Blangiardo | 292/288 |
| 2004/0183315 | A1 * | 9/2004 | O'Donohoe | 292/288 |
| 2006/0254324 | A1 * | 11/2006 | Clifton | 70/14 |
| 2013/0056998 | A1 * | 3/2013 | Chincarini et al. | 292/262 |

* cited by examiner

*Primary Examiner* — Suzanne Barrett

(57) ABSTRACT

A burglary prevention device is used with an existing door having an existing door knob lock and includes a door knob cover including a base suitably sized and shaped to fit over the existing door knob lock, a fastener attached to the base and extending outwardly therefrom, and a flexible chain connected to the fastener and engaged with a bottom edge of the existing door. In this manner, the chain is located exterior of the base. Advantageously, the door knob cover is capable of fitting over the existing door knob lock in such a manner that access is prohibited to the existing door knob lock.

10 Claims, 6 Drawing Sheets

BURGLARY PREVENTION DEVICE AND ASSOCIATED USE THEREOF

CROSS REFERENCE TO RELATED APPLICATIONS

This application claims the benefit of U.S. Provisional Application No. 61/587,853 filed Jan. 18, 2012, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to a burglary prevention device and, more particularly, to a door knob cover placed on the door knob inside of a house that covers manual locking mechanisms to prevent intruders from entering a building by breaking the window on or beside the door and accessing the lock from outside.

2. Prior Art

This year, more than 3 million American families will discover just how devastating a burglary can be. It is the one serious crime that consumers are most likely to suffer, outnumbering the 1.8 million car thefts each year and the 1.1 million robberies. Statistics on reported burglaries nationwide place individual risk of being burglarized at between 2 percent and 3 percent a year, but the odds exceed 5 percent in many cities. The first step in securing a home against burglars is to be sure the house is protected. It is most important to leave no entrances unlocked, most especially on the ground floor. Despite their reputation as second-story men, burglars enter on the ground floor 80 percent of the time. And they get in quickly as the average burglar spends no more than 60 seconds breaking in. An extremely popular way in which trespassers enter homes is by breaking windows that are mounted on or beside a door and actually reaching into the through the broken window and unlocking the door manually. Requiring minimal physical effort, opening a lock in this manner is a relatively simple endeavor, completed by experienced thieves in a manner of seconds.

Accordingly, a need remains for a burglary prevention device in order to overcome prior art shortcomings. The exemplary embodiment(s) satisfy such a need by providing a door knob cover that is convenient and easy to use, lightweight yet durable in design, versatile in its applications, and designed for preventing intruders from entering a home by breaking the window on or beside the door and accessing the lock from outside.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to a burglary prevention device for use with an existing door having an existing door knob lock. These and other objects, features, and advantages of the non-limiting exemplary embodiment(s) are provided by a burglary prevention device including a door knob cover including a base suitably sized and shaped to fit over the existing door knob lock, a fastener attached to the base and extending outwardly therefrom, and a flexible chain connected to the fastener and engaged with a bottom edge of the existing door. In this manner, the chain is located exterior of the base. Advantageously, the door knob cover is capable of fitting over the existing door knob lock in such a manner that access is prohibited to the existing door knob lock.

In a non-limiting exemplary embodiment, the base includes a closed proximal end, an open distal end, and an outer surface extending from the closed proximal end to the open distal end. The chain has a hook attached to a distal end thereof.

In a non-limiting exemplary embodiment, the base has a cylindrical shape and includes first and second curvilinear slotted openings formed along the outer surface. Such first and second slotted openings are located between the closed proximal end and the open distal end. In this manner, the first and second slotted openings extend along first and second mutually exclusive paths defined along diametrically opposed portions of the outer surface. Advantageously, the fastener is passed through the first and second slotted openings and has opposed ends connected together at a location exterior of the base thereby forming a generally ring shape.

In a non-limiting exemplary embodiment, the base includes first, second, third and fourth planar walls connected at respective conjoining edges to form a generally square shape. In this manner, the first planar wall abuts the second planar wall and the third planar wall abuts the fourth planar wall.

In a non-limiting exemplary embodiment, the fastener has opposed ends directly coupled to the open distal end of the base.

In a non-limiting exemplary embodiment, the first planar wall has a U-shaped notch formed therein and fitted about a portion of the existing door knob. In this manner, each of the second, third and fourth planar walls have an entirely continuous and smooth surface area.

In a non-limiting exemplary embodiment, the first and second planar walls have a U-shaped notch formed therein and fitted about portions of the existing door knob, respectively. Notably, each of the third and fourth planar walls has an entirely continuous and smooth surface area.

The present disclosure further includes a method of utilizing a burglary prevention device with an existing door having an existing door knob lock. Such a method includes the chronological steps of: providing a door knob cover including a base; providing and attaching a fastener to the base in such a manner that the fastener extends outwardly from the base; and providing and connecting a flexible chain to the fastener in such a manner that the chain is located exterior of the base. The method further includes the chronological steps of: prohibiting access to the existing door knob lock by fitting the base over the existing door knob lock, and engaging the chain with a bottom edge of the existing door.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
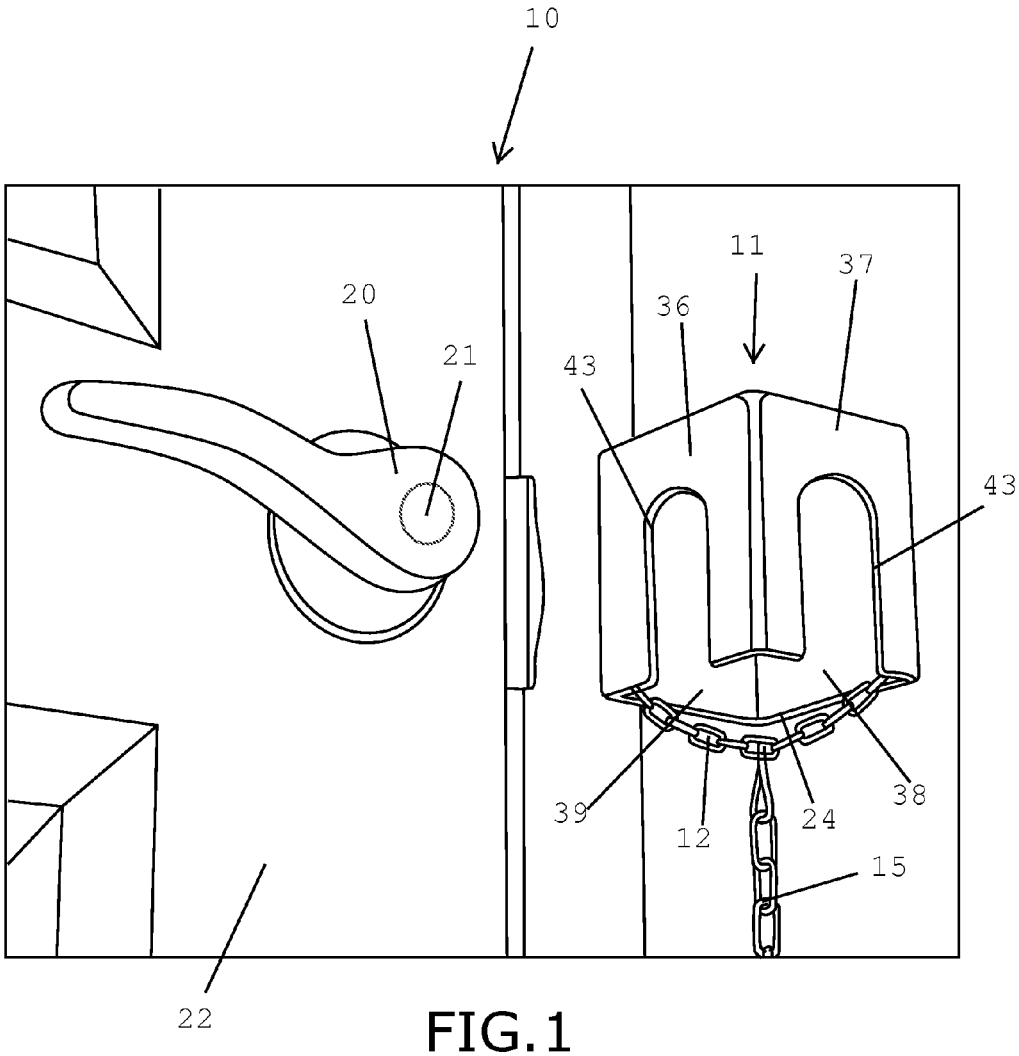
FIG. 1 is a perspective view showing a burglary prevention device positioned adjacent to a door knob, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

A non-limiting exemplary embodiment of the present disclosure is referred to generally in the figures and is intended to provide a burglary prevention device 10. It should be understood that the exemplary embodiment may be used to prevent burglaries at various buildings that may have many different types of door knobs 20, and should not be limited to any particular door knob 20 described herein.

Referring to the FIGS. 1-6 in general, in a non-limiting exemplary embodiment, the burglary prevention device (i.e., door knob cover 10) configured specifically to be applied over an existing door knob 20 and designed to prevent intruders from entering a home by breaking the window on or beside the door 22 and thus accessing the door knob lock 21 from outside. The burglary prevention device 10 may be manufactured primarily of heavy duty plastic material. However, stainless steel and aluminum versions of this product may also be made available.

In a non-limiting exemplary embodiment, the burglary prevention device 10 includes a door knob cover 10 including a base 11 suitably sized and shaped to fit over the existing door knob lock 21, a fastener 12 attached to the base 11 and extending outwardly therefrom, and a flexible chain 15 connected to the fastener 12 and engaged with a bottom edge of the existing door 22. In this manner, the chain 15 is located exterior of the base 11. Advantageously, the door knob cover 10 is capable of fitting over the existing door knob lock 21 in such a manner that access is prohibited to the existing door knob lock 21.

In a non-limiting exemplary embodiment, the base 11 includes a closed proximal end 23, an open distal end 24, and an outer surface 29 extending from the closed proximal end 23 to the open distal end 24. The chain 15 has a hook 16 attached to a distal end 25 thereof.

Figure 5:
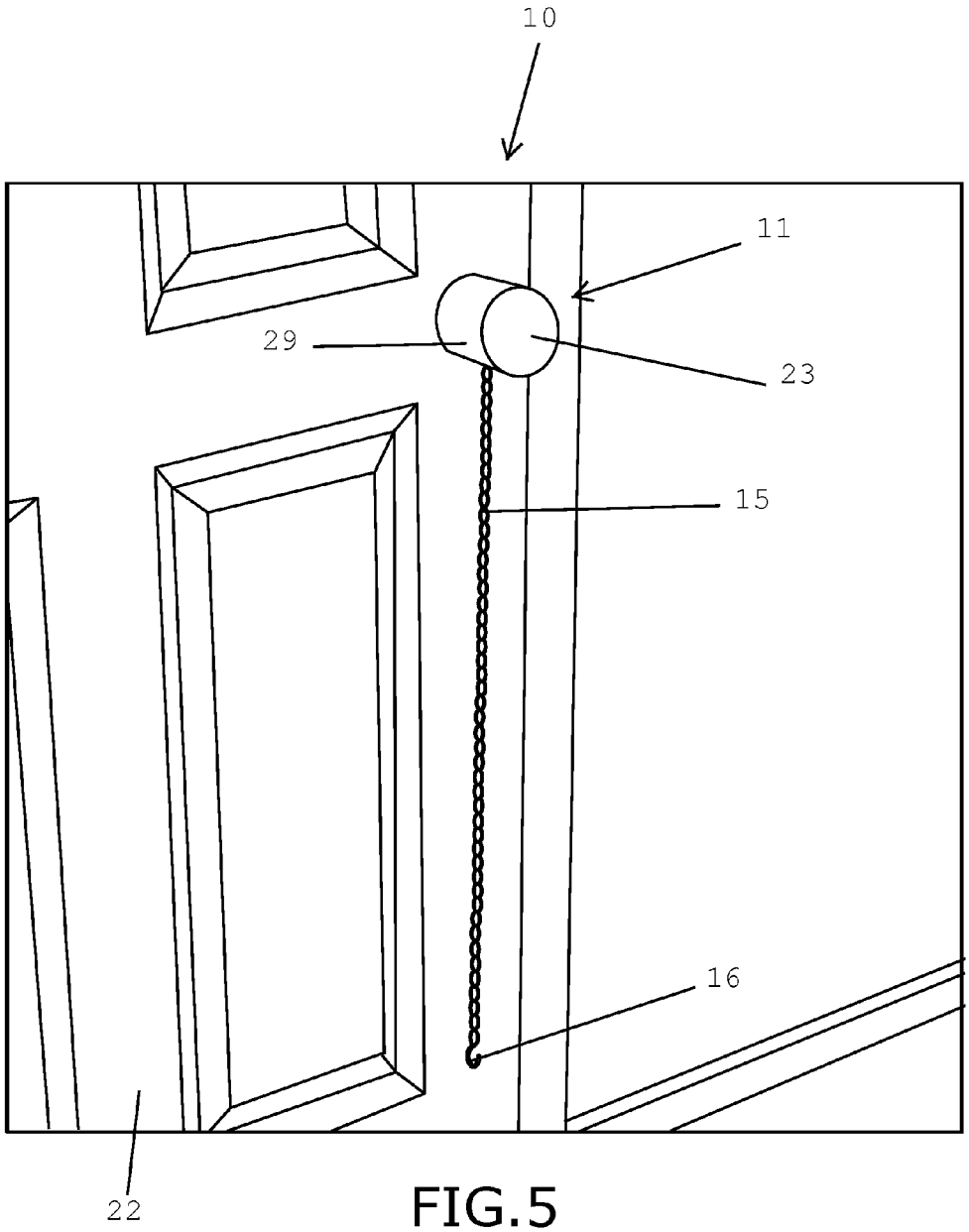
FIG. 5 is a perspective view of the burglary prevention device, shown in FIG. 6, positioned on the door knob.
Figure 6:
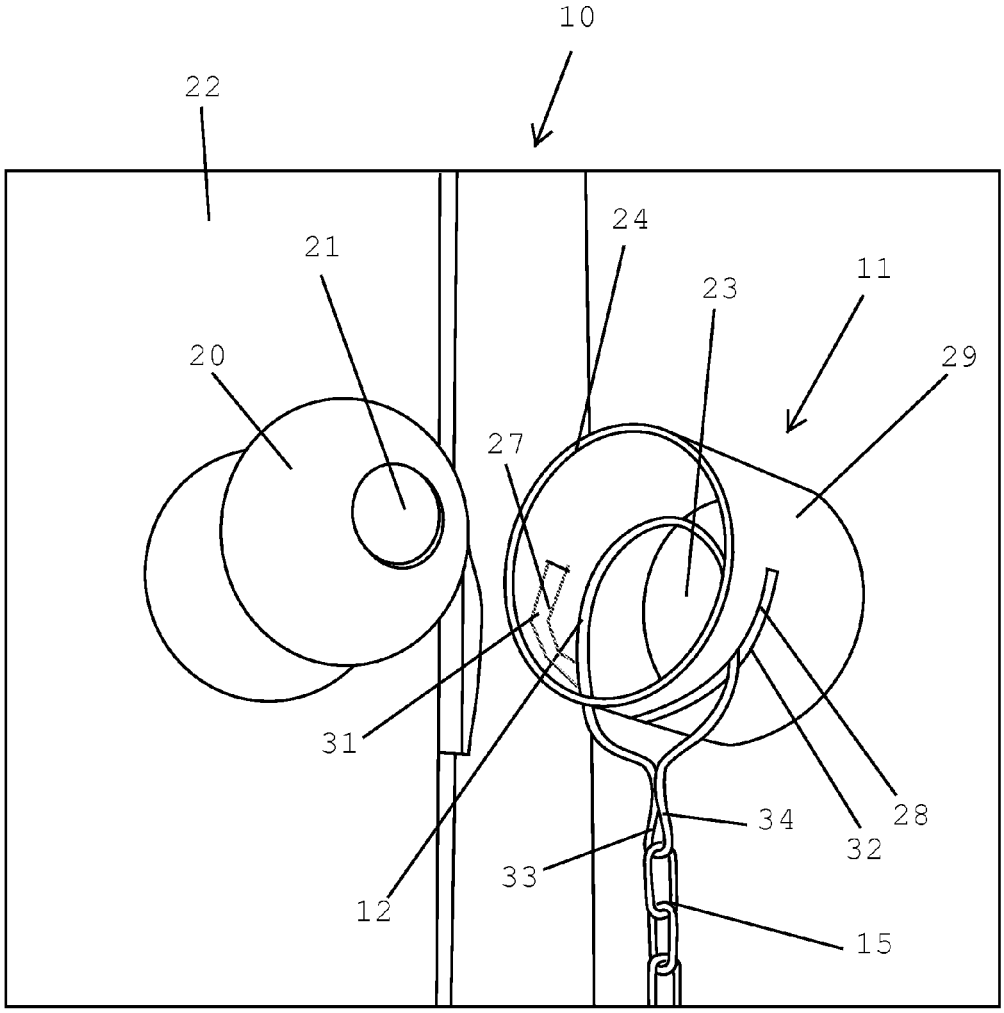
FIG. 6 is a perspective view showing a burglary prevention device positioned adjacent to a door knob, in accordance with a non-limiting exemplary embodiment.

In a non-limiting exemplary embodiment, FIGS. 5-6, the base 11 has a cylindrical shape and includes first and second curvilinear slotted openings 27, 28 formed along the outer surface 29. Such first and second slotted openings 27, 28 are located between the closed proximal end 23 and the open distal end 24. In this manner, the first and second slotted openings 27, 28 extend along first and second mutually exclusive paths 31, 32 defined along diametrically opposed portions of the outer surface 29. Advantageously, the fastener 12 is passed through the first and second slotted openings 27, 28 and has opposed ends 33, 34 connected together at a location exterior of the base 11 thereby forming a generally ring shape.

In a non-limiting exemplary embodiment, FIGS. 1-4, the base 11 includes first, second, third and fourth planar walls 36, 37, 38, 39 connected at respective conjoining edges to form a generally square shape. In this manner, the first planar wall 36 abuts the second planar wall 37 and the third planar wall 38 abuts the fourth planar wall 39.

In a non-limiting exemplary embodiment, FIGS. 1-4, the fastener 12 has opposed ends 33, 34 directly coupled to the open distal end 24 of the base 11.

Figure 2:
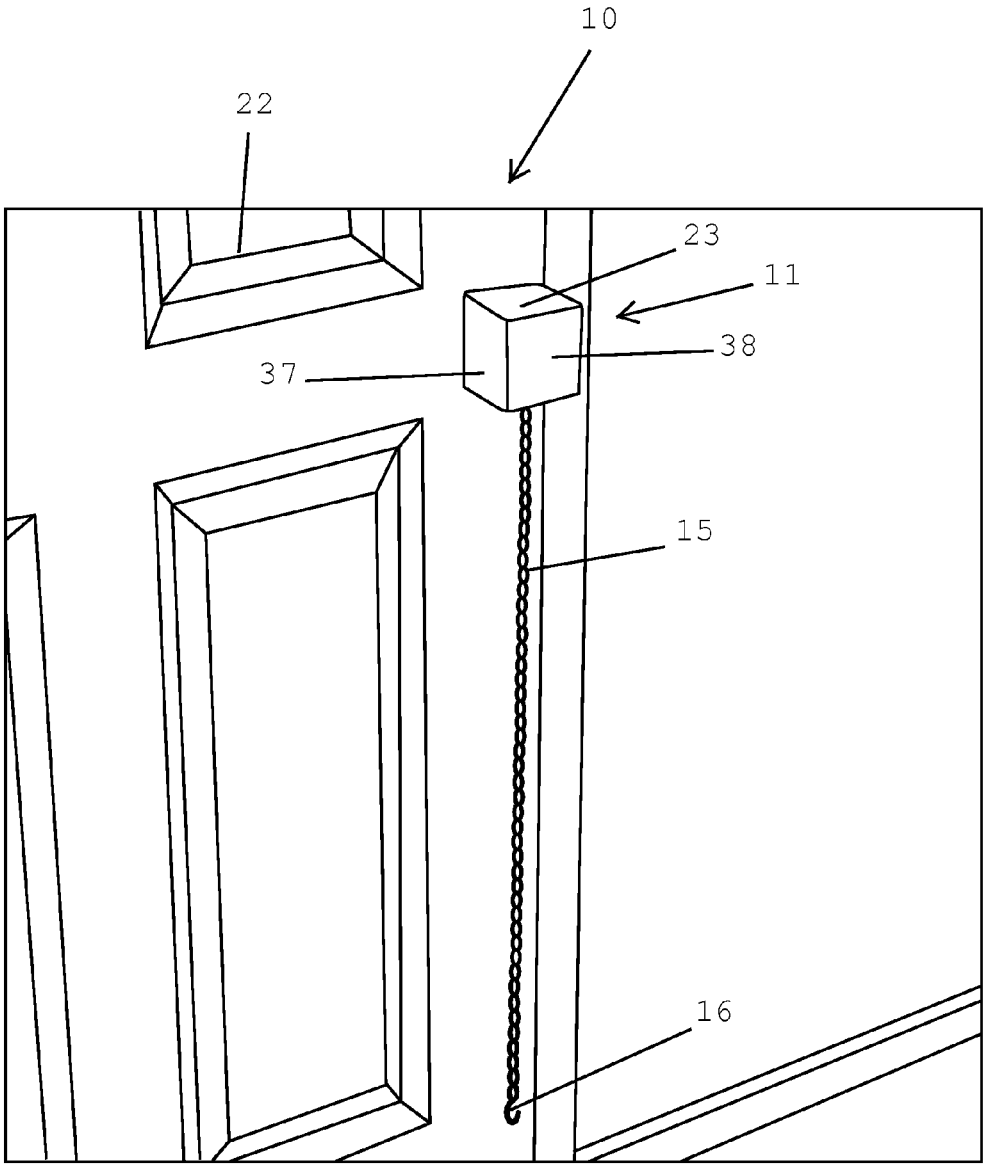
FIG. 2 is a perspective view of the burglary prevention device, shown in FIG. 3, positioned on the door knob.
Figure 3:
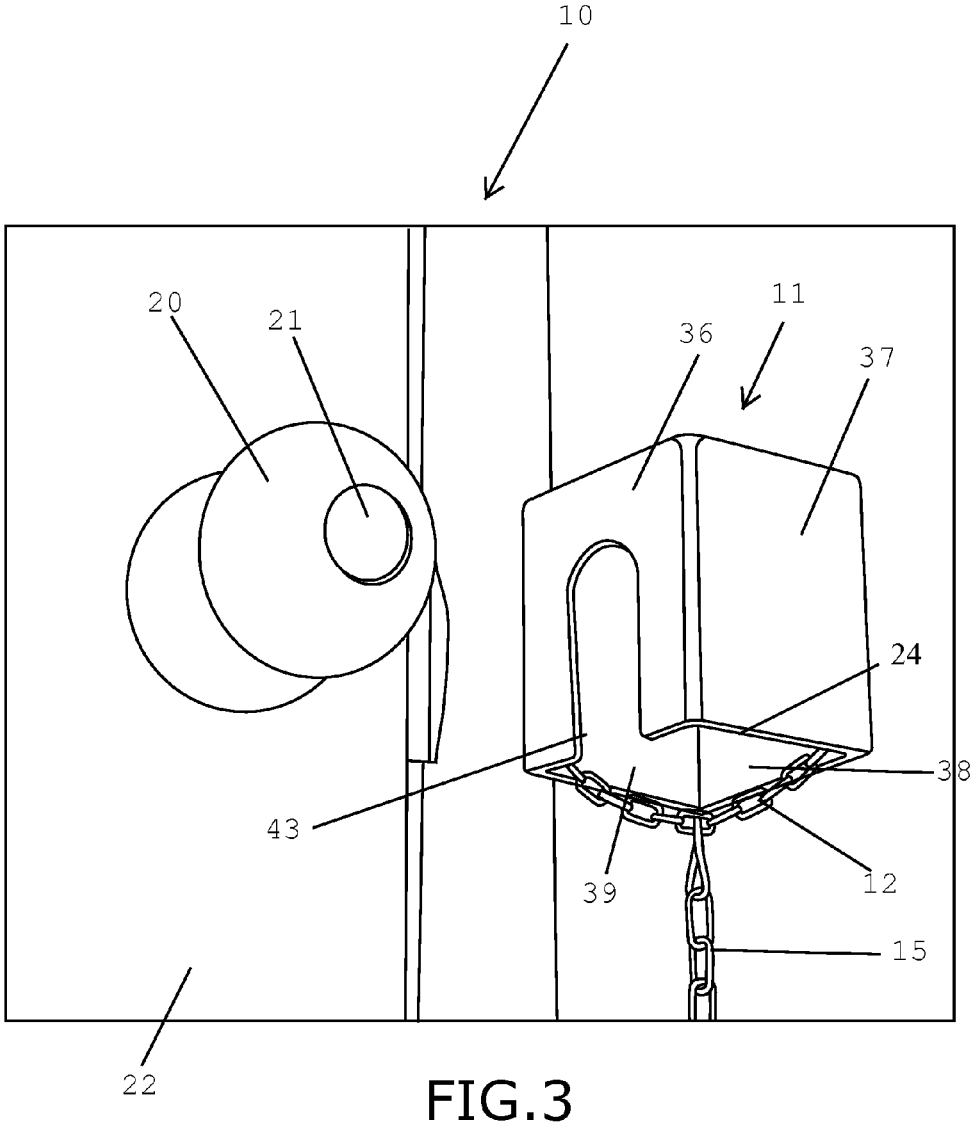
FIG. 3 is a perspective view showing a burglary prevention device positioned adjacent to a door knob, in accordance with a non-limiting exemplary embodiment.

In a non-limiting exemplary embodiment, FIGS. 2-3, the first planar wall 36 has a U-shaped notch 43 formed therein and fitted about a portion of the existing door knob 20. In this manner, each of the second, third and fourth planar walls 37, 38, 39 have an entirely continuous and smooth surface area.

Figure 4:
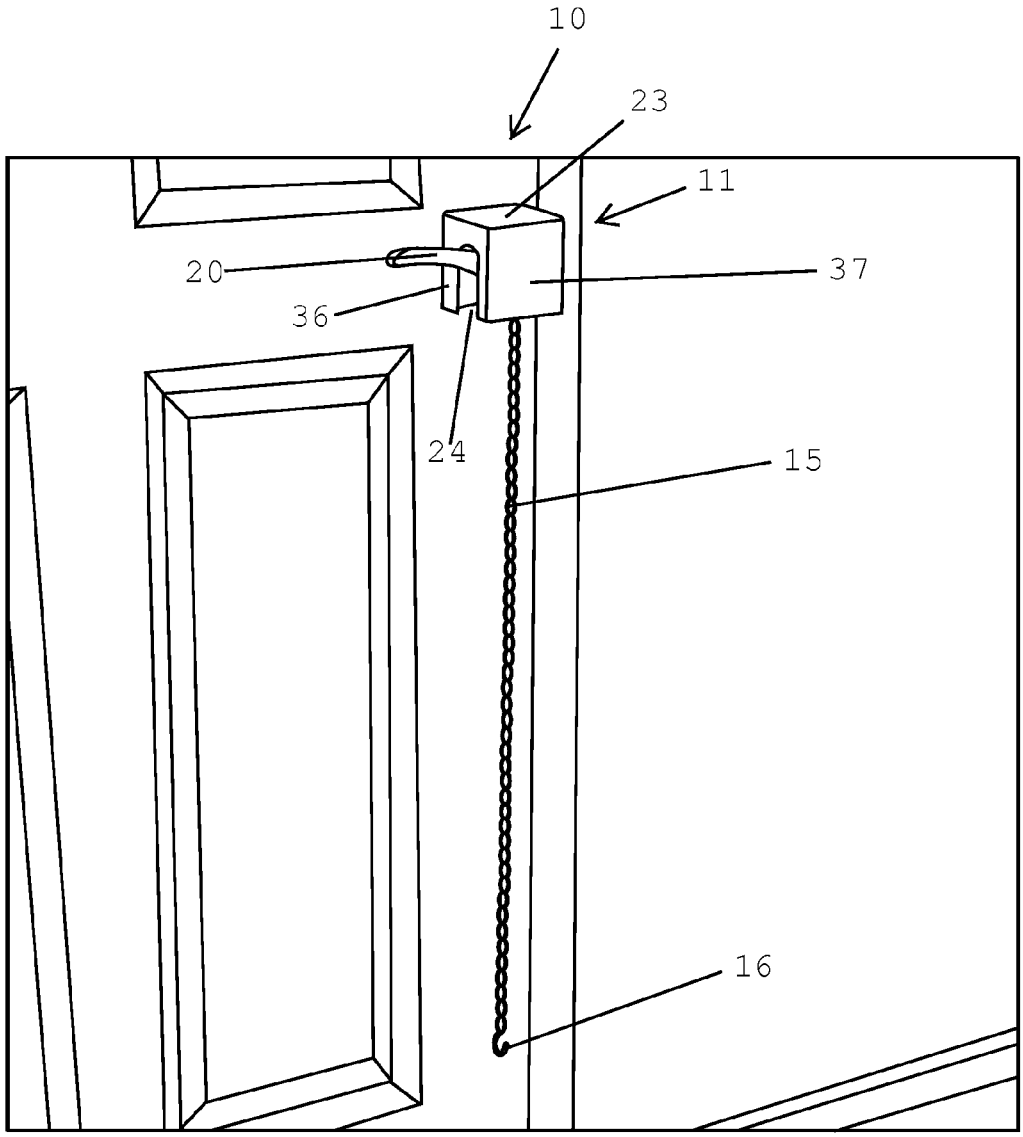
FIG. 4 is a perspective view of the burglary prevention device, shown in FIG. 1, positioned on the door knob.

In a non-limiting exemplary embodiment, FIGS. 1 and 4, the first and second planar walls 36, 37 have a U-shaped notch 43 formed therein and fitted about portions of the existing door knob 20, respectively. Notably, each of the third and fourth planar walls 38, 39 have an entirely continuous and smooth surface area.

The present disclosure further includes a method of utilizing a burglary prevention device 10 with an existing door 22 having an existing door knob lock 21. Such a method includes the chronological steps of: providing a door knob cover 10 including a base 11; providing and attaching a fastener 12 to the base 11 in such a manner that the fastener 12 extends outwardly from the base 11; and providing and connecting a flexible chain 15 to the fastener 12 in such a manner that the chain 15 is located exterior of the base 11. The method further includes the chronological steps of: prohibiting access to the existing door knob lock 21 by fitting the base 11 over the existing door knob lock 21, and engaging the chain 15 with a bottom edge of the existing door 22.

In a non-limiting exemplary embodiment, FIGS. 5-6, cylindrical or dome-like in shape, this device 10 may measure approximately 2.5 inches in length, by approximately 2.5 inches in diameter, with the depth of the unit also measuring approximately 2.5 inches. The burglary prevention device 10 may be offered in two versions, one to accommodate standard door knobs and the second configured to accommodate door knobs featuring an extended handle.

Referring to FIGS. 5-6, the first version of the burglary prevention device 10 may feature an open, circular shaped base 11, configured to slide over the door knob, resting flush against the base of the door knob 20 and actual door 22. A ring-like fastener 12 may run through slotted openings 27, 28 incorporated into base 11 and are utilized to securely tighten device 10 about the door knob lock 21.

In a non-limiting exemplary embodiment, the underside of the second version of device 10 may feature notch 43, the end of which may be softly rounded. This notch 43 may be configured to slide over the door knob 21, while accommodating the knob's extended handle. In either version, a sturdy, linked chain 15 may be integrally attached to the base 11 of the door knob cover 10. A screw or hook-like fastener 16 may be connected to the distal end 25 of the chain 15 for securing chain 15 to the bottom of the actual door 22 on which the door knob cover 10 may be located.

In a non-limiting exemplary embodiment, installation and use of the burglary prevention device 10 may be very simple and straight forward. First, the user may purchase the door knob cover 10 in a version appropriate for their actual door 22. Prior to applying the door knob cover 10, the user may lock the designated door knob lock 21. The user may then simply slide the door knob cover 10 over the door knob 20 and, in the case of the first embodiment, secure the ring-like fastener 12 incorporated into the base 11. Next, the user may secure the linked chain 15 that runs from the base 11 of the door knob cover 10 to the bottom of the door 22, and thereby mount the chain 15 in place via a screw or hook fastener 16. With the door knob cover 10 properly applied, an intruder is unable to unlock the door knob lock 21 or turn the door handle 20, even if he/she has broken a nearby window and attempted to reach inside to manually unlock the door knob lock 21. Homeowners who possess a key to the door knob lock 21, however, may be able to open the door from the outside by inserting the key, releasing the lock 21 and turning the door handle 20, in turn releasing the actual burglary prevention device 10.

In a non-limiting exemplary embodiment, installation of door knob cover 10 provides consumers a simple way in which to prevent their door locks 21 from being opened by an intruder who breaks a window in an attempt to infiltrate one's front or back door 22. A specially designed protective guard designed to fit over the actual door knob 20 and secured to the base of the door 22, the burglary prevention device 10 effectively prevents an intruder from turning the door handle 20 and entering an innocent victim's home. As such, the burglary prevention device 10 offers consumers a simple, easy and reliable way in which to protect themselves from burglars and other intruders. The burglary prevention device 10 may also be utilized on virtually any door knob 20, making this product ideal for use on office door knobs, businesses and similar establishments.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A burglary prevention device for use with an existing door having an existing door knob lock, said burglary prevention device comprising:

a door knob cover including a base;

a fastener attached to said base and extending outwardly therefrom; and a chain connected to said fastener and capable of being engaged with a bottom edge of the existing door;

wherein said door knob cover is capable of fitting over the existing door knob lock in such a manner that access is prohibited to the existing door knob lock;

wherein said base comprises a closed proximal end, an open distal end, and an outer surface extending from said closed proximal end to said open distal end;

wherein said chain has a hook attached to a distal end thereof;

wherein said base has a cylindrical shape and comprises first and second curvilinear slotted openings formed along said outer surface;

wherein said first and second slotted openings are located between said closed proximal end and said open distal end;

wherein said first and second slotted openings extend along first and second mutually exclusive paths defined along diametrically opposed portions of said outer surface;

wherein said fastener is passed through said first and second slotted openings and has opposed ends connected together at a location exterior of said base thereby forming a generally ring shape.

2. The burglary prevention device of claim 1, wherein said base comprises: first, second, third and fourth planar walls connected at respective conjoining edges to form a generally square shape;

wherein said first planar wall abuts said second planar wall;

wherein said third planar wall abuts said fourth planar wall.

3. The burglary prevention device of claim 2, wherein said fastener has opposed ends directly coupled to said open distal end of said base.

4. The burglary prevention device of claim 3, wherein said first planar wall has a U-shaped notch formed therein and fitted about a portion of the existing door knob; wherein each of said second, third and fourth planar walls have an entirely continuous and smooth surface area.

5. The burglary prevention device of claim 3, wherein said first and second planar walls have a U-shaped notch formed therein and fitted about portions of the existing door knob, respectively; wherein each of said third and fourth planar walls have an entirely continuous and smooth surface area.

6. A burglary prevention device for use with an existing door having an existing door knob lock, said burglary prevention device comprising:

a door knob cover including a base suitably sized and shaped to fit over the existing door knob lock;

a fastener attached to said base and extending outwardly therefrom; and a flexible chain connected to said fastener and capable of being engaged with a bottom edge of the existing door;

wherein said door knob cover is capable of fitting over the existing door knob lock in such a manner that access is prohibited to the existing door knob lock;

wherein said chain is located exterior of said base;

wherein said base comprises a closed proximal end, an open distal end, and an outer surface extending from said closed proximal end to said open distal end;

wherein said chain has a hook attached to a distal end thereof;

wherein said base has a cylindrical shape and comprises first and second curvilinear slotted openings formed along said outer surface;

wherein said first and second slotted openings are located between said closed proximal end and said open distal end;

wherein said first and second slotted openings extend along first and second mutually exclusive paths defined along diametrically opposed portions of said outer surface;

wherein said fastener is passed through said first and second slotted openings and has opposed ends connected together at a location exterior of said base thereby forming a generally ring shape.

7. The burglary prevention device of claim 6, wherein said base comprises: first, second, third and fourth planar walls connected at respective conjoining edges to form a generally square shape;

wherein said first planar wall abuts said second planar wall;

wherein said third planar wall abuts said fourth planar wall.

8. The burglary prevention device of claim 7, wherein said fastener has opposed ends directly coupled to said open distal end of said base.

9. The burglary prevention device of claim 8, wherein said first planar wall has a U-shaped notch formed therein and fitted about a portion of the existing door knob; wherein each of said second, third and fourth planar walls have an entirely continuous and smooth surface area.

10. The burglary prevention device of claim 8, wherein said first and second planar walls have a U-shaped notch formed therein and fitted about portions of the existing door knob, respectively; wherein each of said third and fourth planar walls have an entirely continuous and smooth surface area.

* * * * *